United States Patent [19]

Bernard et al.

[11] 4,424,428

[45] Jan. 3, 1984

[54] PERMANENT MAGNET ROTATING ARC SWITCH

[75] Inventors: Georges Bernard, Saint-Egreve; Serge Olive, St. Paul de Varces; Francesco Scarponi, Brignoud, all of France

[73] Assignee: Merlin Gerin S.A., Grenoble, France

[21] Appl. No.: 250,156

[22] Filed: Apr. 2, 1981

[30] Foreign Application Priority Data

Apr. 4, 1980 [FR] France ..... 80 07904

[51] Int. Cl.[3] ..... H01H 33/18

[52] U.S. Cl. ..... 200/147 A

[58] Field of Search ..... 200/147 A

[56] References Cited

U.S. PATENT DOCUMENTS

| | | | |
|---|---|---|---|
| 2,725,446 | 11/1955 | Slepian | 200/147 A |
| 3,082,307 | 3/1963 | Greenwood | 200/144 B |
| 4,225,762 | 9/1980 | Zuckler | 200/147 A |

FOREIGN PATENT DOCUMENTS

| | | | |
|---|---|---|---|
| 967984 | 1/1958 | Fed. Rep. of Germany | 200/147 A |
| 1236628 | 3/1967 | Fed. Rep. of Germany | 200/147 A |
| 2752765 | 5/1979 | Fed. Rep. of Germany | 200/147 A |
| 1042344 | 6/1953 | France | 200/147 A |
| 1171319 | 10/1958 | France | 200/147 A |
| 2389219 | 11/1978 | France | 200/147 A |

*Primary Examiner*—Robert S. Macon

*Attorney, Agent, or Firm*—Parkhurst & Oliff

[57] ABSTRACT

The invention concerns a rotating arc switch using a permanent magnet (38) arc blow-out. The permanent magnet is housed inside the fixed contact (16) and is thermally and electrically isolated from it by an insulating layer (46). The permanent magnet (38) is placed against the annular contact (36) surface, very close to the breaking zone, and has a cavity (40) opposite the central opening of the annular surface (36). The magnetic blow-out is combined with a pneumatic blow out by escape of the warmed gases towards an expansion chamber (36).

8 Claims, 2 Drawing Figures

PERMANENT MAGNET ROTATING ARC SWITCH

The invention concerns a rotating arc switch comprising:

a tight enclosure filled with an insulating gas having a high dielectric strength, a pair of contacts housed in said enclosure and having annular contact surfaces coming into abutment in the closed position, said contacts being separable by relative movement in a direction perpendicular to the annular contact surfaces, a cylindrical housing arranged within one of the contacts, an annular electrode surrounding the periphery of the bottom of the cylindrical housing opposite the other contact and whose leading face constitutes the annular surface of the associated contact, a permanent magnet lodged within said housing so as to develop a magnetic field in the annular contact separation zone and to compel rotation of the arc drawn upon said annular surfaces between the separated contacts.

The advantages of rotating arc switches are well-known, notably the reduced operating force of the mechanism and the limited contact erosion. Switches having an arc blow-out coil have already been built and are satisfactory. These switches of the prior art include means for bringing the coil into circuit at the appearance of the arc, generally by use of a transfer electrode which complicates the arrangement of the contacts. The arc transfer takes place with a predetermined delay, and there is always the danger that arc migration will put the coil out of circuit, thus hindering current interruption.

The use of permanent magnets for arc blow-out overcomes these disadvantages, but the strength of the magnetic blow-out field and consequently the breaking capacity are limited.

The object of the invention is to provide a permanent magnet switch ensuring energetic arc blow-out without the risk of demagnetizing the magnet.

In accordance with the present invention, the permanent magnet is placed up against the rear face of the annular electrode and includes a central cavity arranged in line with the central orifice of the annular electrode so as to prevent establishment of the arc on the central portion of the magnet and to constrain the arc within the annular zone of maximum magnetic blow-out field strength.

The magnet which is placed within the contact and close to the annular electrode forming the arc root migration track, develops a strong magnetic blow-out field in the arc zone, while being screened from any demagnetizing fields generated by currents flowing through the contact surrounding the magnet. The central cavity of the annular electrode and the permanent magnet prevents establishment of the arc on the central area of the contact where the field strength is nil. The breaking interval as defined by the contacts contains no metallic object liable to attract the arc, the latter being constrained to the annular tracks in the zone of maximum blow-out, without the use of insulating coatings subject to arc action.

The permanent magnet may be shaped as a solid, axially magnetized cylinder having a central blind cavity or as a radially magnetized toroid.

The enclosure is filled with an electronegative gas such as sulfure hexafluoride, and according to an important development of the invention, magnetic blow-out of the arc is combined with pneumatic blow-out obtained by division of the enclosure volume into two chambers, one containing the separable contacts and the other constituting an exhaust volume for the gases compressed by the action of the arc, the communication between the two chambers being arranged as a pneumatic arc blow-out nozzle.

Other advantages and characteristics of the invention will become clearer in the following description of two applications given as non-restrictive examples and represented in the attached drawing in which.

Figure 1:
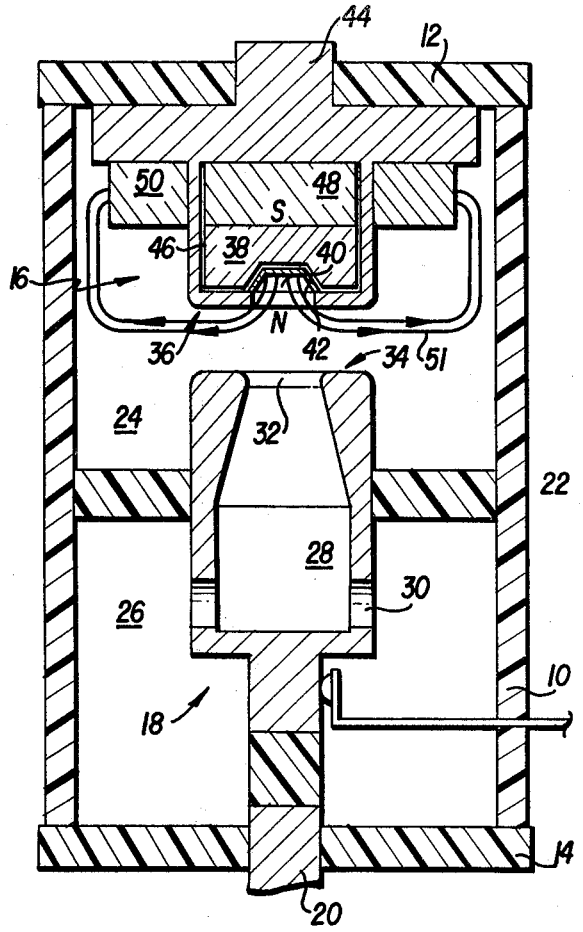
FIG. 1 is a schematic cross-section of a switch according to the invention and shown in the open position.

On the drawings an insulating cylindrical enclosure 10 is closed at its ends by plates 12, 14. The enclosure is filled with an electro-negative gas such as sulfur hexafluoride, preferably under pressure. Axially mounted inside enclosure 10 are a fixed contact designated 16 and a movable contact 18, sliding axially, and rigidly attached to a control rod 20 passing through end plate 14 by means of a tight joint. An internal partition 22 divides the internal volume of enclosure 10 into two chambers 24 and 26, the movable contact 18 traversing the partition 22. Chamber 24, which constitutes the breaking chamber of the switch, contains contacts 16 and 18, while chamber 26 forms an exhaust volume for the gases compressed by the action of the arc drawn-out in chamber 24. The tubular movable contact 18 constitutes a passage between chambers 24, 26, the internal volume 28 of the tubular contact communicating on the one hand with chamber 26 via the radial orifices 30 and on the other hand with chamber 24 by way of the open end 32. The annular rim 34 of the movable contact 18 constitutes the annular contact surface which comes in the closed position into abutment with the fixed contact 16. The rim 34 constitutes an annular migration track for the root of the arc drawn between the separated contacts 16,18. The hollow cylindrical fixed contact 16 of a diameter equivalent to that of the movable contact 18 offers on its flat face opposite the movable contact 18, an electrode or annular contact surface 36 which cooperates with the corresponding annular surface 34 in the closed position. Within the hollow cylinder forming contact 16 is housed a cylindrical permanent magnet 38 the base of which is placed up against the rear face of the annular electrode 36. The axially magnetized permanent magnet 38 has a cavity or blind hole 40 in its central area opposite the orifice of the annular electrode 36. A metal screen covers the wall of the cavity 40 and is attached to the circular edges of the electrode 36. It is easy to see that the face of the magnet opposite the movable contact 18 has its periphery covered by the annular electrode 36 and its central area covered by the metallic screen 42. The fixed contact 16 is fixed to the base 12 of enclosure 10, the latter being traversed by a current input terminal 44. The permanent magnet 38 is insulated both electrically and thermally from the fixed contact 16 by an insulating layer 46 covering on the one hand the cylindrical surface of the magnet 38 and on the other hand the flat surface butting against the electrode 36. It is clear that the current flowing through the fixed contact 16 is confined to the external cylindrical portion of the contact 16 and does not give rise to any magnetic field inside the contact liable to demagnetize the permanent magnet 38. The rear face of the permanent magnet 38 is hard up against the magnetic carcass 48 which promotes the cooling by thermal conduction of the magnet 38. The presence of the carcass 48 increases the intensity of the magnetic field generated by the magnet 38, and this carcass 48 is extended by an external ring 50 of the contact 16. Referring more particularly to FIG. 1, in which are shown the lines of force 51 of the magnet 38, we see that part 50 of carcass 48 modifies the direction of the lines of force so as to bring them sensibly horizontal on the figure in the separation zone of the contacts 16, 18. The latter are made of a non-magnetic material.

The switch according to the invention functions as follows:

In the closed position of the switch, the current passes from the fixed contact 16 towards the movable contact 18 by way of the annular butt-jointed contact surfaces 34, 36. The current flowing across the contacts 16, 18 does not pass through the permanent magnet 38 and gives rise to no magnetic field liable to demagnetize the magnet housed inside the fixed contact 16. The magnet 38 generates a magnetic field that is permanently present. The opening of the contacts by the downward sliding in the figure of the movable contact 18 produces separation of the annular contact surfaces 34, 36, and the arc is drawn out essentially along the switch axis. The magnetic field of magnet 38, which is present when the arc appears, leads to rotation of the arc along the annular tracks formed by contact surfaces 34, 36 and rapid extinction of the arc in a wellknown manner. It should be remembered that the arc confines itself to the annular tracks 34, 36 because of the absence of any other metallic object in this area. Screen 42 protects magnet 38 from the action of the arc, particularly from the hot ionized gases. No insulating object is present in the breaking zone. Arc extinction is facilitated by the gaseous flow escaping through the tubular contact 18 towards chamber 26. It should be noted that the presence of the cavity 40 allows the permanent magnet 38 to be situated very close to the breaking zone, the strength of the magnetic blow-out field being increased by the carcass 48, 50.

In spite of this layout, with the magnet close to the breaking zone, the magnet is perfectly protected both by the metallic screen 42 and by the insulating layer that separates it from the fixed contact 16. The carcass 48 acts as a heat sink to prevent any excessive heating of the magnet 38, and the latter, housed inside contact 16, is shielded from demagnetizing fields.

Figure 2:
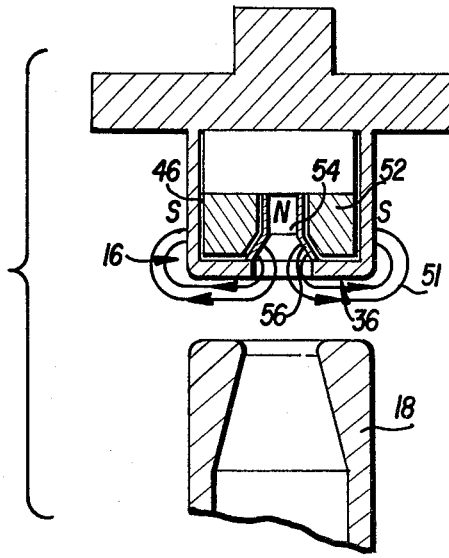
FIG. 2 is a partial view similar to FIG. 1 of another embodiment.

FIG. 2 illustrates another embodiment in which the same reference numbers are used to designate components identical or similar to those in FIG. 1. The permanent magnet housed within fixed contact 16, is in the form of a toroid of which the diameter of the central opening corresponds with the diameter of the central hole of the annular electrode 36. The toroid is radially magnetized and it is easy to see that the lines of force 51 shown schematically in FIG. 2 are of a shape similar to that obtained with the solid cylindrical magnet 38 in the variant according to FIG. 1. The carcass 48 is dispensed with, and the screen 42 is transformed into a screen in the form of a sleeve lining the inside of the toroid 52. The cylindrical part of contact 16 can be in a ferro-magnetic material to diminish the reluctance of the magnetic circuit. The tubular form of the permanent magnet 52 allows the gases to escape through the fixed contact 16 and a double blow-out of the arc.

The permanent magnet 38, 52 can be a ferrite or metallic magnet or any other appropriate type, and the insulating layer 46 inserted between the magnet and the contact can be a polytetrafluorethylene product.

What is claimed is:

1. Rotating arc switch comprising:

a tight enclosure filled with an insulating gas having a high dielectric strength;

first and second contacts housed within said enclosure and having respective annular contact surfaces coming into abutment in a closed position, said contacts being separable in an open position by relative movement extending along a direction perpendicular to said annular contact surfaces;

an annular arc zone arranged between said contact surfaces in the open position;

a cylindrical housing comprising a part of said first contact, including a ring-shaped electrode surrounding a central aperture, and having a front face which constitutes said annular contact surface associated to the first contact, and a rear face;

a permanent magnet lodged within said cylindrical housing so as to develop a magnetic field in said annular arc area, and to compel rotation of the arc drawn upon said annular separated contact surfaces, the permanent magnet being placed up against the rear face of said ring-shaped electrode having a central office;

a central cavity provided in said permanent magnet and located close to the central orifice of said ring-shaped electrode so as to prevent establishment of the arc in said central cavity of the magnet and to constrain the arc within said annular arc area of maximum magnetic blow-out field strength.

2. Switch according to claim 1, wherein said permanent magnet has a solid cylindrical configuration including flat opposite end faces which constitute the polar faces of said magnet and wherein said central cavity of the magnet is formed by a blind hole extending coaxially with the central orifice of said electrode.

3. Switch according to claim 1, wherein said permanent magnet includes a radially magnetized toroid.

4. Switch according to claim 2, wherein said blind hole is covered by a conducting screen protecting said permanent magnet from arc action.

5. Switch according to claim 1, wherein an insulating layer separates said permanent magnet from the electrode of said first contact as to thermally and electrically insulate said permanent magnet.

6. Switch according to claim 5, wherein said permanent magnet has a rear end face arranged in substantial thermal contact with a carcass acting as a heat extractor.

7. Switch according to claim 1, wherein a carcass is placed at the back of the permanent magnet to reinforce the magnetic blow-out fields, said carcass extending beyond the outside of said first contact in order to give an optimum field spectrum in said arc area.

8. Switch according to claim 1, wherein an internal partition wall divides said enclosure into two chambers which communicate through a nozzle arranged within said secod contact, this latter being axially movable through said partition wall and cooperating in the closed position by abutment with said first contact surrounding the permanent magnet having a tubular structure so as to allow a double axial pneumatic blow-out of the arc drawn between said first and second contacts.

* * * * *